US005564229A

United States Patent [19]

Noska

[11] Patent Number: 5,564,229

[45] Date of Patent: Oct. 15, 1996

[54] HALF CIRCLE WINDOW COVERING

[76] Inventor: Carl H. Noska, 10660 Plano Rd., #118, Dallas, Tex. 75238

[21] Appl. No.: 555,190

[22] Filed: Nov. 8, 1995

[51] Int. Cl.[6] ..... E06B 7/02

[52] U.S. Cl. ..... 49/39

[58] Field of Search ..... 49/38, 39, 41; 454/221, 224, 278

[56] References Cited

U.S. PATENT DOCUMENTS

| | | | |
|---|---|---|---|
| 415,378 | 11/1889 | Buffham | 49/39 |
| 1,399,435 | 12/1921 | Capsley | 49/39 X |
| 1,707,101 | 3/1929 | Taylor | 49/41 |
| 1,797,293 | 3/1931 | McIlvaine | 49/39 |
| 2,137,924 | 11/1938 | Schickedanz | 49/39 |
| 3,221,634 | 12/1965 | Helle et al. | 49/385 |
| 4,104,827 | 8/1978 | Opron et al. | 49/385 |

FOREIGN PATENT DOCUMENTS

| | | | |
|---|---|---|---|
| 6074550 | 3/1994 | Japan | 454/224 |

*Primary Examiner*—Kenneth J. Dorner
*Assistant Examiner*—Jerry Redman
*Attorney, Agent, or Firm*—Joseph H. McGlynn

[57] ABSTRACT

A half-circle window covering, consisting of two fan-shaped portions with perforations cut to allow for ventilation and/or light to enter a room. The innermost fan-shaped portion has a notch removed from one lower edge to allow for pivoting of the innermost fan-shaped portion when a rod is engaged to open or close the innermost portion. The entire unit may be installed either over the upper portion of an arched window to increase or decrease the amount of light entering a room or may be installed over a doorway in an interior wall to allow light and/or ventilation to enter an interior room.

4 Claims, 1 Drawing Sheet

HALF CIRCLE WINDOW COVERING

BACKGROUND OF THE INVENTION

This invention relates, in general, to a decorative and functional arch for an interior window covering, and, in particular, to a half-circle arch that will allow ventilation when needed but maintain privacy when desired.

Many of today's buildings, whether residential or commercial, contain arched windows which allow too much sunlight into a room, thus causing fading of fabrics and carpeting and creating an uncomfortable room temperature. The present invention is designed specifically to close, as needed, to maintain a comfortable room temperature. On the other hand, the present invention may be used on interior walls where needed, i.e. over interior doorways, to allow an interior room to be ventilated by air coming through windows or doorways in an outer room.

DESCRIPTION OF THE PRIOR ART

In the prior art various types of window coverings have been suggested. For example, U.S. Pat. No. 2,137,924 shows a window ventilator which consists of a two sliding panels having circular adjustable air inlet structures with rows of fine perforations which rotate to align with perforations on the sliding panels. Upon finger adjustment of the circular structures, air is allowed to enter a room to the desired degree, thus avoiding drafts.

U.S. Pat. No. 4,104,827 shows a two-part pivoting and sliding window for an automobile, one portion of which pivots to the side, allowing half of the window to be opened completely.

U.S. Pat. No. 415,378 is a window ventilator having one stationary ring and a pivoting ring which can be moved to allow air to enter a room.

U.S. Pat. No. 3,221,634 shows a fresh-air valve designed for ventilation only, the inner plate of which is stationary and the outer plate of which rotates by means of a chain pull to open and close the valve.

All of the prior art is designed for ventilation only.

SUMMARY OF THE INVENTION

The present invention is designed to be both decorative and functional, creating an esthetically pleasing addition to a window or room that will allow light control and/or desired ventilation.

The instant invention has two decorative and functional fan-shaped ventilation portions which may be mounted over the uppermost portion of a window which has an arched, half-circle shape or may be mounted over an inner doorway to allow light and ventilation from outer windows to penetrate to interior rooms. Both fan-shaped portions of each unit may be cut one atop the other to attain identical fan shapes and identical perforations of any shape desired may be cut for ventilation purposes. The innermost fan-shaped portion has a notch removed from one lower edge, thus creating openings which are offset from the openings in the outermost fan-shaped portion when mounted together as a unit. The outermost fan-shaped portion has a small slotted opening completely through on the right edge through which a rod is mounted to the innermost fan-shaped portion. The opening and closing of the fan-shaped ventilation system is attained by way of a cylindrical rod mounted by a screw or bolt to the innermost fan-shaped portion through a slotted opening in the outermost fan-shaped portion.

At the bottom center of the fan-shaped portions, a screw or bolt is passed through a pivot point, securely fastening both fan-shaped portions together to form a unit. The hole for the screw or bolt at the pivot point may be covered by any type of decorative trim desired. Flexible molding strips are used to form a track for the fan-shaped unit.

These and other objects and advantages of the present invention will be fully apparent from the following description, when taken in connection with the annexed drawings.

DESCRIPTION OF THE PREFERRED EMBODIMENT

Figure 1:
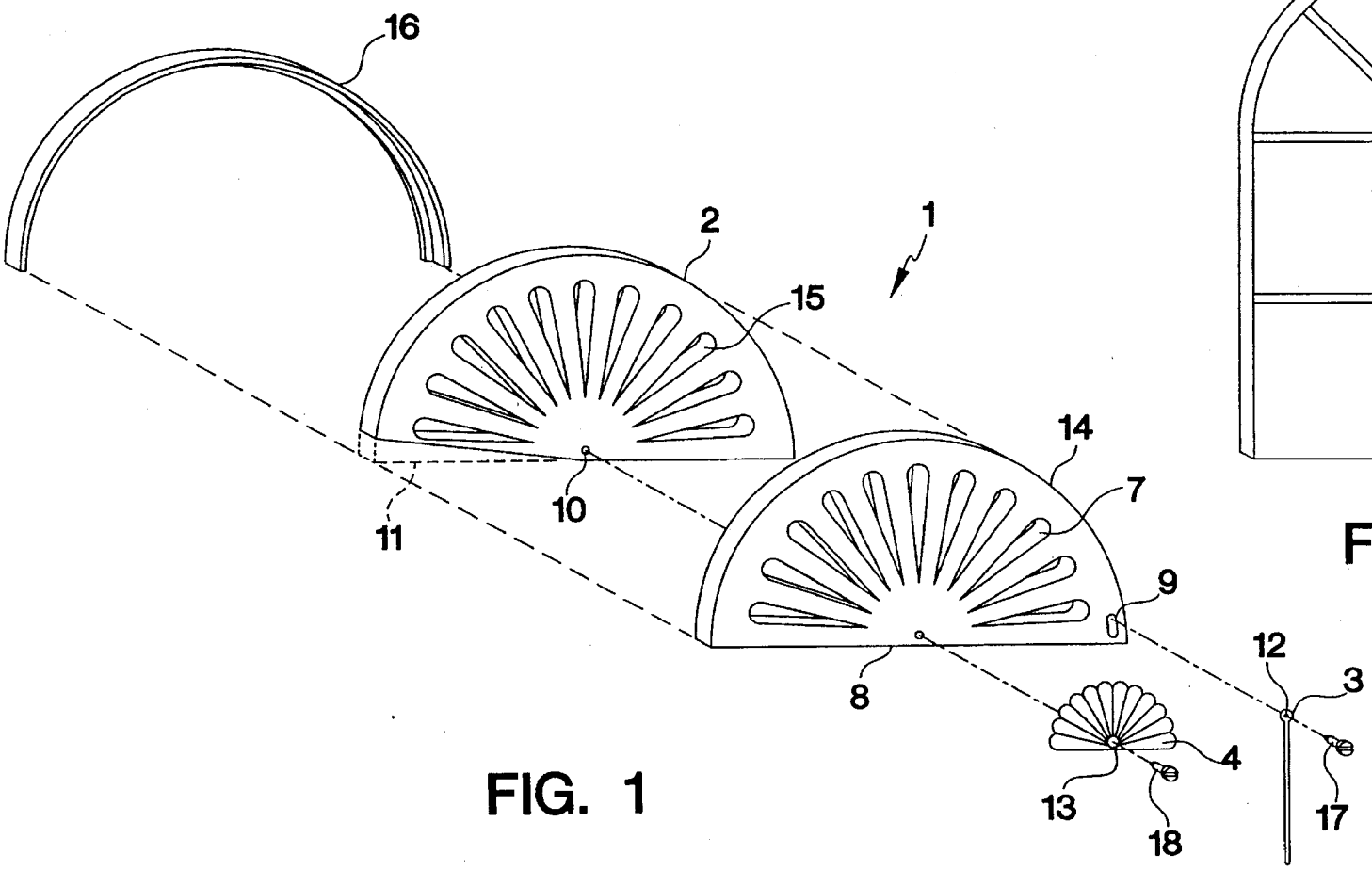
FIG. 1 is an exploded view of the fan-shaped ventilation portions showing their relationship to one another, the pivotal operation of the fan-shaped portions and the use of the cylindrical rod for opening and closing the innermost fan-shaped portion.

Referring now to the drawings in greater detail, FIG. 1, shows an exploded view of the half-circle window covering 1 to illustrate the manner in which the window covering portions are assembled and how they operate. The outer dimensions of fan-shaped portions 14 and 2 and the perforations 7 and 15 may be cut with an identical template, the only difference between fan-shaped portions 14 and 2 being the notched portion 11 which is removed on the fan-shaped portion 2 to allow for the pivotal movement of the innermost fan-shaped portion 2. The outermost fan-shaped portion 14 does not have the notched portion removed.

For the inside of an exterior window, the outermost fan-shaped portion 14 and the innermost fan-shaped portion 2 are provided with holes 8 and 10 at the bottom center portion of each of the fan-shaped portions 14 and 2. The ornamental fixture 4 is also provided with a hole 13, through which a screw 18 is passed to attach the ornamental fixture 4, the outermost fan-shaped portion 14 and the innermost fan-shaped portion 2 to the window frame 6, shown in FIG. 2. The screw is tightened with a friction fit to allow for free movement of the innermost fan-shaped portion 2 when the rod 3 is used to move the inner portion 15 with respect to the outer portion 14. However, the fit should not be so tight that it will restrict the movement of portion 2. Vertical slot 9 is provided in outer portion 14, through which the rod 3 is mounted to the innermost fan-shaped portion 2 by a screw 17 through hole 12 in the rod 3. When the rod 3 is engaged by moving it up or down, the innermost fan-shaped portion 2 will either open or close depending upon the direction of movement of the rod 3. Molding strips made of a resilient material, i.e., polyethylene or rubber, are used to form a track 16, into which the assembled fan-shaped unit is mounted. The track 16 would be a semicircular track with an internal channel into which the pieces 2 and 14 will fit.

Figure 2:
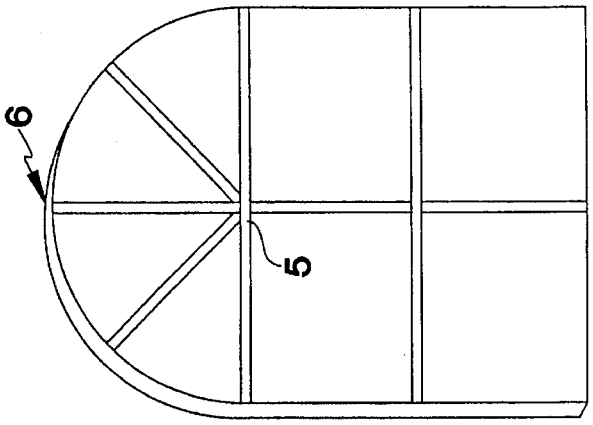
FIG. 2 is a typical window with a fan-shaped top, to which top window section, the half-circle window covering may be mounted.

FIG. 2 shows a window 6 onto which the half circle covering I may be mounted at the center point 5 of the uppermost horizontal crossbar of the window.

In another embodiment, the half-circle window covering may be installed over a doorway in an interior wall. The manner in which the window covering portions are assembled and how they operate are the same as for the exterior window installation. The outer dimensions of fan-shaped portions 14 and 2 and the perforations 7 and 15 may be cut with an identical template, the only difference between fan-shaped portions 14 and 2 being the notched portion 11 which is removed on the fan-shaped portion 2 to allow for the pivotal movement of the innermost fan-shaped portion 2. The outermost fan-shaped portion 14 does not have the notched portion removed.

Although the present invention has been described as being mounted on an exterior window, it should be understood that it could also be mounted on an interior window or opening in order to provide ventilation between rooms. The construction and mounting on an interior window or opening would be the same as the exterior location.

Also, other means for moving the innermost fan shaped portion 2 can be employed. For example, a small stepper motor can be attached to the portion 2 and the motor can be operated by a remote controlled operator similar to a garage door opener. The remote control, if engaged once, would start the motor in order to move inner portion 2 in one direction. If engaged again, the remote controlled operator would start the motor and move inner portion 2 in the opposite direction. Since these remote controlled operators are conventional, they are not shown in the drawings.

In addition, if the window is within reach a knob could be substituted for the rod 3.

Although the half-circle window covering and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A covering for a semicircular window comprising:

a first semicircular member having a straight bottom portion and a curved upper portion with an arc of approximately 180°, said first semicircular member having a first set of apertures therethrough, a second semicircular member having a straight bottom portion and a curved upper portion with an arc of less than 180°, said second semicircular member having a second set of apertures therethrough which are identical to said first set of apertures in said first semicircular member, said second semicircular member being movable from a first position in which said first and second set of apertures are in alignment, to a second position in which said first and second set of apertures are not in alignment, said first semicircular member having a slot adjacent said straight bottom portion, means extending through said slot and engaging said second semicircular member for moving said second semicircular member with respect to said first semicircular member.

2. The covering for a semicircular window as claimed in claim 1, wherein said slot is a vertical slot.

3. The covering for a semicircular window as claimed in claim 1, wherein said means extending through said slot and engaging said second semicircular member is a rod with a projection on an end of said rod.

4. The covering for a semicircular window as claimed in claim 1, wherein said means extending through said slot and engaging said second semicircular member is a knob.

* * * * *